US010206528B1

(12) United States Patent
Lequio di Assaba et al.

(10) Patent No.: US 10,206,528 B1
(45) Date of Patent: Feb. 19, 2019

(54) ROUND SERVING TRAY AND ACCESSORY SYSTEM

(71) Applicants: Clemente Lequio di Assaba, Doral, FL (US); Andrea Fernandez, Miami, FL (US)

(72) Inventors: Clemente Lequio di Assaba, Doral, FL (US); Andrea Fernandez, Miami, FL (US)

( * ) Notice: Subject to any disclaimer, the term of this patent is extended or adjusted under 35 U.S.C. 154(b) by 0 days.

(21) Appl. No.: 15/933,308

(22) Filed: Mar. 22, 2018

(51) Int. Cl.
*A47G 23/06* (2006.01)
*A47G 23/02* (2006.01)

(52) U.S. Cl.
CPC ..... *A47G 23/0633* (2013.01); *A47G 23/0208* (2013.01); *A47G 23/0225* (2013.01)

(58) Field of Classification Search
CPC .... A47G 23/0225; A47G 19/04; A47G 19/06; A47G 23/0208; A47G 23/02; A47G 23/0633; A47G 23/0641; A47G 9/1045; B65D 1/265
USPC ..... 220/737
See application file for complete search history.

(56) References Cited

U.S. PATENT DOCUMENTS 2,602,311 A * 7/1952 Hansen ..... A47G 23/0633 220/737
2,795,121 A * 6/1957 Pantello ..... A47G 19/04 220/23.83
2,916,180 A * 12/1959 Alger ..... A47G 19/08 211/41.2
5,361,932 A * 11/1994 Friedrich ..... A47G 19/04 206/217
2009/0120948 A1* 5/2009 Ezzy ..... A47G 23/0225 220/737

* cited by examiner

*Primary Examiner* — Shawn M Braden
(74) *Attorney, Agent, or Firm* — Ruben Alcoba, Esq.

(57) ABSTRACT

A round serving tray and accessory system used to secure stemware. The serving tray and accessory system comprises an arcuate sleeve that has an inner and outer part, and a top, a bottom, a first and a second side. The top inner part of the sleeve defines an arcuate cavity wherein an innermost part of the sleeve is curved upward. The outer part of the sleeve defines an arcuate shoulder, the arcuate shoulder has a top, a bottom, a first and a second side, the bottom side of the arcuate shoulder defines and arcuate opening that linearly runs from the first side of the arcuate shoulder to the second side of the arcuate shoulder. And, a round serving tray that has a raised edge, the arcuate sleeve is mounted on the raised ledge of the serving tray via the arcuate opening so that the inner part of the sleeve rests on the round serving tray.

4 Claims, 2 Drawing Sheets

ROUND SERVING TRAY AND ACCESSORY SYSTEM

BACKGROUND

The present invention is directed to a serving tray and accessory system that is used to transport and secure stemware on a round serving tray.

Round serving trays are often used to transport stemware in the restaurant and bar industries.

The reason that round serving trays are used is to provide a central axis balancing point that allows a server to easily transport the stemware while minimizing the risk of the stemware falling of the serving tray.

Yet, even providing a central axis balancing point, often stemware slips off the round serving trays. Reasons can be slippery serving trays or unforeseen temporary losses of the balancing point due to the environment in which they are transported.

The present invention is designed to further minimize the slippage of stemware from a round serving tray.

The present invention also serves to protect the raised edges of the serving trays from being damaged. Damage to serving trays occurs, in the business, when servers place serving trays down in hurried fashion or when the trays inadvertently fall. Damages that typically occur to trays are cracks or chips. The damage normally occurs to the raised edges of the serving tray, for the raised edges is the most vulnerable part of a serving tray. The present invention will extend the life of serving trays in the business.

For the foregoing reason there is a need for a serving tray and accessory system that will secure stemware on a serving tray.

SUMMARY

The present invention describes a serving tray and accessory system that secures stemware on the service tray. The serving tray and accessory system comprises an arcuate sleeve that has an inner and outer part, and a top, a bottom, a first and a second side. The top inner part of the sleeve defines an arcuate cavity wherein an innermost part of the sleeve is curved upward. The outer part of the sleeve defines an arcuate shoulder, the arcuate shoulder has a top, a bottom, a first and a second side, the bottom side of the arcuate shoulder defines and arcuate opening that linearly runs from the first side of the arcuate shoulder to the second side of the arcuate shoulder. And, a round serving tray that has a raised edge, the arcuate sleeve is mounted on the raised edge of the serving tray so that the inner part of the sleeve rests on the round serving tray.

The arcuate shoulder is designed to protect the raised edge of the serving tray while simultaneously providing an accessory that will secure stemware to the serving tray.

In preferred embodiments of the present invention, the arcuate shoulder will be made of an elastomeric material that will slightly bend upwards when the base of the stemware is secured between the serving tray and the inner bottom of the arcuate shoulder.

An object of the present invention is to provide a serving tray and accessory system that will secure stemware on a service tray.

Another object of the present invention is to provide a serving tray and accessory system that will prolong the life of a service tray.

DRAWINGS

These and other features, aspects, and advantages of the present invention will become better understood with regards to the following description, appended claims, and drawings where:

DESCRIPTION

Figure 1:
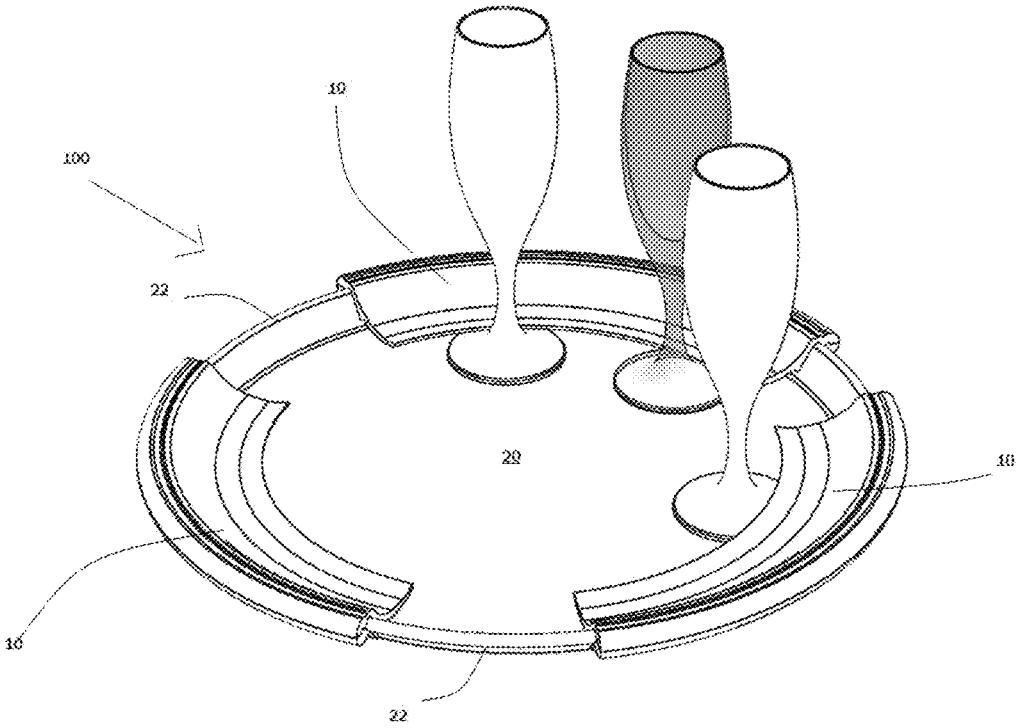
FIG. 1 is a perspective view of the present invention.
Figure 2:
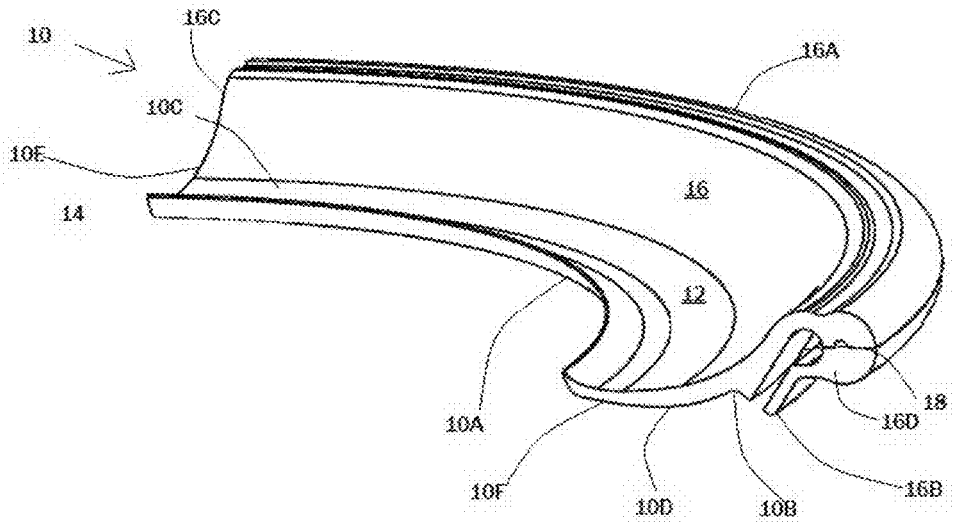
FIG. 2 is a perspective view of the arcuate sleeve of the present invention.

As seen in FIGS. 1-2, the present invention describes a round serving tray and accessory system 100 used to secure stemware. The serving tray and accessory system 100 comprises an arcuate sleeve 10 that has an inner 10*a* and outer part 10*b*, and a top 10*c*, a bottom 10*d*, a first 10*e* and a second side 10*f*, wherein the top inner part of the arcuate sleeve 10 defines an arcuate cavity 12 wherein an innermost part 14 of the arcuate sleeve 10 is curved upward, and the outer part 10*b* of the sleeve defines an arcuate shoulder 16, the arcuate shoulder 16 has a top 16*a*, a bottom 16*b*, a first 16*c* and a second side 16*d*, the bottom side 16*b* of the arcuate shoulder 16 defines and arcuate opening 18 that linearly runs from the first side 16*c* of the arcuate shoulder 16 to the second side 16*d* of the arcuate shoulder 16. And, a round serving tray 20 that has a raised edge 22, the arcuate sleeve 10 is mounted on the raised edge 22 of the serving tray 20 via the arcuate opening 18 so that the inner part 10*a* of the arcuate sleeve 10 rests on the round serving tray 20.

In preferred embodiments, the arcuate sleeve 10 will be made of polymeric or elastomeric material.

In preferred embodiments, the arcuate sleeve 10 will have a circumference that will have a length that will be at least one fourth of the circumference of the round serving tray 20.

In some embodiments, the arcuate sleeve shall be permanently fixed on the serving tray.

An advantage of the present invention is that it provides a serving tray and accessory system that secures stemware on a service tray.

Another advantage of the present invention is that it provides a serving tray and accessory system that prolongs the life of a service tray.

While the inventor's above description contains many specificities, these should not be construed as limitations on the scope, but rather as an exemplification of several preferred embodiments thereof. Accordingly, the scope should not be determined by the embodiments illustrated, but by the appended claims and their legal equivalents.

What is claimed is:

1. A round serving tray and accessory system used to secure stemware, the serving tray and accessory system comprises:

An arcuate sleeve that has an inner and outer part, and a top, a bottom, a first and a second side, the arcuate sleeve is made of an elastomeric material and has a circumference that has a length that measures at least one fourth of the circumference of the round serving tray, wherein:

the top inner part of the sleeve defines an arcuate cavity wherein an innermost part of the arcuate sleeve is curved upward; and the outer part of the arcuate sleeve defines an arcuate shoulder, the arcuate shoulder has a top, a bottom, a first and a second side, the bottom side of the arcuate shoulder defines and arcuate opening that linearly runs from the first side of the arcuate shoulder to the second side of the arcuate shoulder; and a round serving tray that has a raised edge, the arcuate sleeve is mounted on the raised edge of the serving tray via the arcuate opening so that the inner part of the arcuate sleeve rests on the round serving tray.

2. The round serving tray and accessory system used to secure stemware of claim 1, wherein the arcuate sleeve is permanently fixed on the serving tray.

3. A round serving tray and accessory system used to secure stemware, the serving tray and accessory system comprises:

An arcuate sleeve that has an inner and outer part, and a top, a bottom, a first and a second side, the arcuate sleeve is made of a polymeric material and has a circumference that has a length that measures at least one fourth of the circumference of the round serving tray, wherein:

the top inner part of the sleeve defines an arcuate cavity wherein an innermost part of the arcuate sleeve is curved upward; and the outer part of the arcuate sleeve defines an arcuate shoulder, the arcuate shoulder has a top, a bottom, a first and a second side, the bottom side of the arcuate shoulder defines and arcuate opening that linearly runs from the first side of the arcuate shoulder to the second side of the arcuate shoulder; and a round serving tray that has a raised edge, the arcuate sleeve is mounted on the raised edge of the serving tray via the arcuate opening so that the inner part of the arcuate sleeve rests on the round serving tray.

4. The round serving tray and accessory system used to secure stemware of claim 3, wherein the arcuate sleeve is permanently fixed on the serving tray.

* * * * *